US006585198B2

(12) United States Patent
Dillon

(10) Patent No.: US 6,585,198 B2
(45) Date of Patent: Jul. 1, 2003

(54) WRIST SUPPORT FOR USE WITH A COMPUTER MOUSE

(76) Inventor: Carmen Dillon, 221 Sydenham Street, Brantford, Ontario (CA), N3L 3Z6

( * ) Notice: Subject to any disclaimer, the term of this patent is extended or adjusted under 35 U.S.C. 154(b) by 0 days.

(21) Appl. No.: 10/074,080

(22) Filed: Feb. 12, 2002

(65) Prior Publication Data

US 2002/0113175 A1 Aug. 22, 2002

(30) Foreign Application Priority Data

Feb. 14, 2001 (CA) ..... 2336423

(51) Int. Cl.[7] ..... B43L 15/00
(52) U.S. Cl. ..... 248/118.5; 248/918; 400/715
(58) Field of Search ..... 400/715; 248/118.1, 248/118.5, 918, 118; 128/878, 879; D14/460, 461

(56) References Cited

U.S. PATENT DOCUMENTS 2,477,898 A * 8/1949 Rehman et al. ..... 248/118
3,295,518 A * 1/1967 Hazlewood et al. ..... 128/877
3,815,588 A * 6/1974 Klausner ..... 602/4
4,106,143 A * 8/1978 Lucas ..... 441/74
4,259,949 A * 4/1981 Axelsson ..... 602/20
4,576,351 A * 3/1986 Brink ..... 248/118
4,941,480 A * 7/1990 McLean et al. ..... 128/878
5,265,835 A * 11/1993 Nash ..... 248/118
5,335,888 A * 8/1994 Thomsen ..... 248/118.5
5,340,067 A * 8/1994 Martin et al. ..... 248/118.5
5,383,632 A * 1/1995 Shirlin et al. ..... 248/118.5
5,681,268 A * 10/1997 Radman ..... 602/20
5,762,302 A * 6/1998 Myers ..... 248/118.5
5,868,365 A 2/1999 Hesley ..... 248/118
5,925,007 A * 7/1999 Ashline ..... 602/21
5,944,289 A * 8/1999 Speece ..... 248/118.5
6,193,196 B1 * 2/2001 Hesley ..... 248/118.1

* cited by examiner

*Primary Examiner*—Ramon O. Ramirez
*Assistant Examiner*—Jon Szumny
(74) *Attorney, Agent, or Firm*—John H. Thomas, PC

(57) ABSTRACT

A wrist support for supporting a hand, wrist and forearm of a person during operation a computer mouse. The support forms a channel or cradle, which receives the palm, wrist and upper forearm. The support further comprises a thumb support extending and a fifth finger support extending to create an abducted position of the thumb and fifth finger relative to the remainder of the hand to relieve pressure on the median nerve in the wrist, leaving the second, third, and forth finger to operate the mouse. This configuration may ease strain on the wrist and may be advantageously used by persons with carpal tunnel syndrome. This support is constructed from hard plastic material and has a base which glides freely over hard flat surfaces.

13 Claims, 4 Drawing Sheets

WRIST SUPPORT FOR USE WITH A COMPUTER MOUSE

FIELD OF THE INVENTION

The present invention relates generally to wrist supporting devices, and, more particularly, to wrist supports for use with a computer mouse.

BACKGROUND OF THE INVENTION

The median nerve travels through an anatomic space at the base of the palm of the hand known as the carpal tunnel. When external pressure is applied to the carpal tunnel, that pressure is transmitted to the median nerve. If a person puts significant stress upon the heel of the hand, either as a result of repetitive impacts (vibrational or otherwise) or as a result of long term weight bearing impacts, then injury to the median nerve of the hand may occur. The injury is typically experienced as numbness and tingling of the thumb, index, middle, and part of the ring fingers of the hand. This phenomenon is know as repetitive stress injury, or carpal tunnel syndrome.

Computer users may be at risk for carpal tunnel syndrome as a result of frequent use of a computer mouse. When moving a computer mouse to control a cursor on a computer screen ("mousing"), the user tends to balance the weight of his/her hand on the heel of the hand in order to keep the fingers freely mobile in order to operate the mouse buttons. Furthermore, the user will tend to pivot on his/her hand on its heel in order to move the computer mouse laterally. Additionally, when a computer user rests the weight of his/her forearm on the heel of the hand significant pressure is applied to the wrist, with the result that the user's wrist is frequently hypo and/or hyper flexed. Repeated or prolonged flexion of the wrist in either direction may pinch the carpal tunnel and irritate the medial nerve which passes through the carpal tunnel. Computer users frequently spend long periods of time at the computer and they typically use a computer mouse throughout the time when the computer is in use.

Accordingly, conditions are created where long term weight bearing pressure and repetitive impact pressure are applied to the heel of a mouse user's hand, and prolonged or repeated hyper and/or hypo flexion of the wrist. Such impacts and strain can, over time, result cause a computer mouse user to develop carpal tunnel syndrome. The incidence and debilitating effects of carpal tunnel syndrome in mouse users is well established, but since many people use computers in their jobs on a daily basis, they are forced to continue using a computer mouse for long periods of time despite considerable discomfort and potential long term medical damage.

Many ergonomically designed devices are available for supporting the wrist of a computer mouse user. Most such devices include a platform for supporting the mouse and a stationary pad for supporting the wrist.

Other wrist supports for carpal tunnel syndrome are attached directly to the wrist and hand. Supports which are attached directly to the wrist of a wearer limit the wearer's freedom of movement and may inhibit a user's ability to move from mousing to using the computer keyboard. Moreover, wrist support devices that are attached to the wrist can cause the user to strain his/her fingers or hand by attempting to work beyond the restrictions of the wrist support. Additionally, the prolonged use of a wrist support, which is attached to the wrist and which partially or completely immobilizes the wrist, can cause the muscles of the user's wrist and forearm to become atrophied.

It is an object of the present invention to provide a wrist support for use with a computer mouse which will allow full and free movement of the hand, wrist and arm during mousing.

It is a further object of the present invention to provide a wrist support which receives and cradles the wrist of the user in a neutral position.

It is yet a further object of the present invention to provide a wrist support which also supports the first and fifth finger ensuring that the wrist stays in a neutral position.

It is a further object of the present invention to provide a wrist support that glides easily with the mouse over all hard surfaces causing little surface tension, therefore reducing stress to the elbow and shoulder.

SUMMARY OF THE INVENTION

In accordance with the present invention there is disclosed a wrist support for use with a computer mouse comprising a substantially rigid main body portion contoured to cradle a heel of the hand, a wrist and a distal portion of the forearm of a user. The main body portion of the wrist support defines a longitudinally extending channel to supportingly receive the heel of the hand, the wrist and the distal portion of the forearm.

A thumb support and a fifth finger support extend longitudinally beyond the main body portion to maintain the thumb and fifth finger of a user isolated an abducted position relative to the palm of the hand to relieve pressure on the median nerve of the user's wrist. The thumb support and the fifth finger support define a recessed area therebetween which is sized and positioned to receive, in non-contacting relation, a computer mouse.

The wrist support further comprises a base portion to maintain the wrist support in stable aligned horizontal contact with a hard flat surface and to permit the wrist support to glide freely over the hard flat surface.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

DETAILED DESCRIPTION OF THE PREFERRED EMBODIMENT

Figure 1:
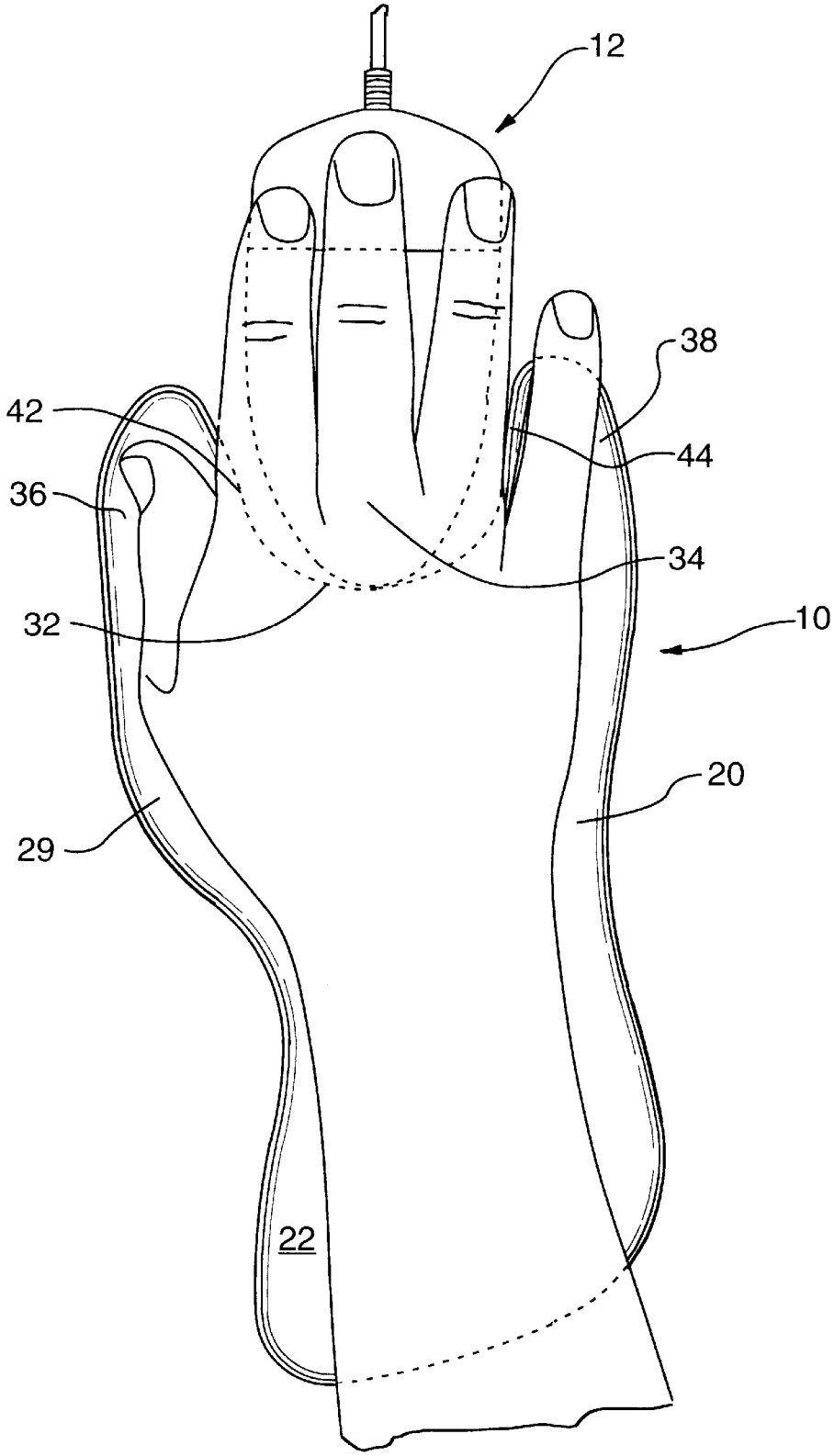
FIG. 1 is a top plan view of a wrist support for a computer mouse constructed in accordance with a preferred embodiment of the present invention, shown in use with the hand and forearm of a user.

Referring now to FIG. 1 of the drawings, a wrist support according to a preferred embodiment of the present invention, designated by general reference numeral 10, is shown in conjunction with a representation of a computer mouse, and supporting the hand and forearm of a notional user. Those portions of the wrist support 10 and the computer mouse 12 which would ordinarily be covered by the hand during the use of the present invention are shown in dotted outline in FIG. 1.

As illustrated in FIG. 1, the wrist support 10 is designed to receive a computer mouse 12. The wrist support 10 comprises main body portion 20 which may be somewhat rectangular in shape, with the overall width being slightly wider that the user's wrist. The thickness of the main body portion 20 varies at different positions, as will be discussed in greater detail below, but in general, the thickness is approximately ½" to 1½ inches and corresponds to a position about the same height as the mid point of the computer mouse 12. Accordingly, when the hand of a user is in cradled in the in-use position upon the wrist support 10, the user's hand will extend comfortably over the computer mouse 12 without causing hyper-flexion of the wrist.

Figure 2:
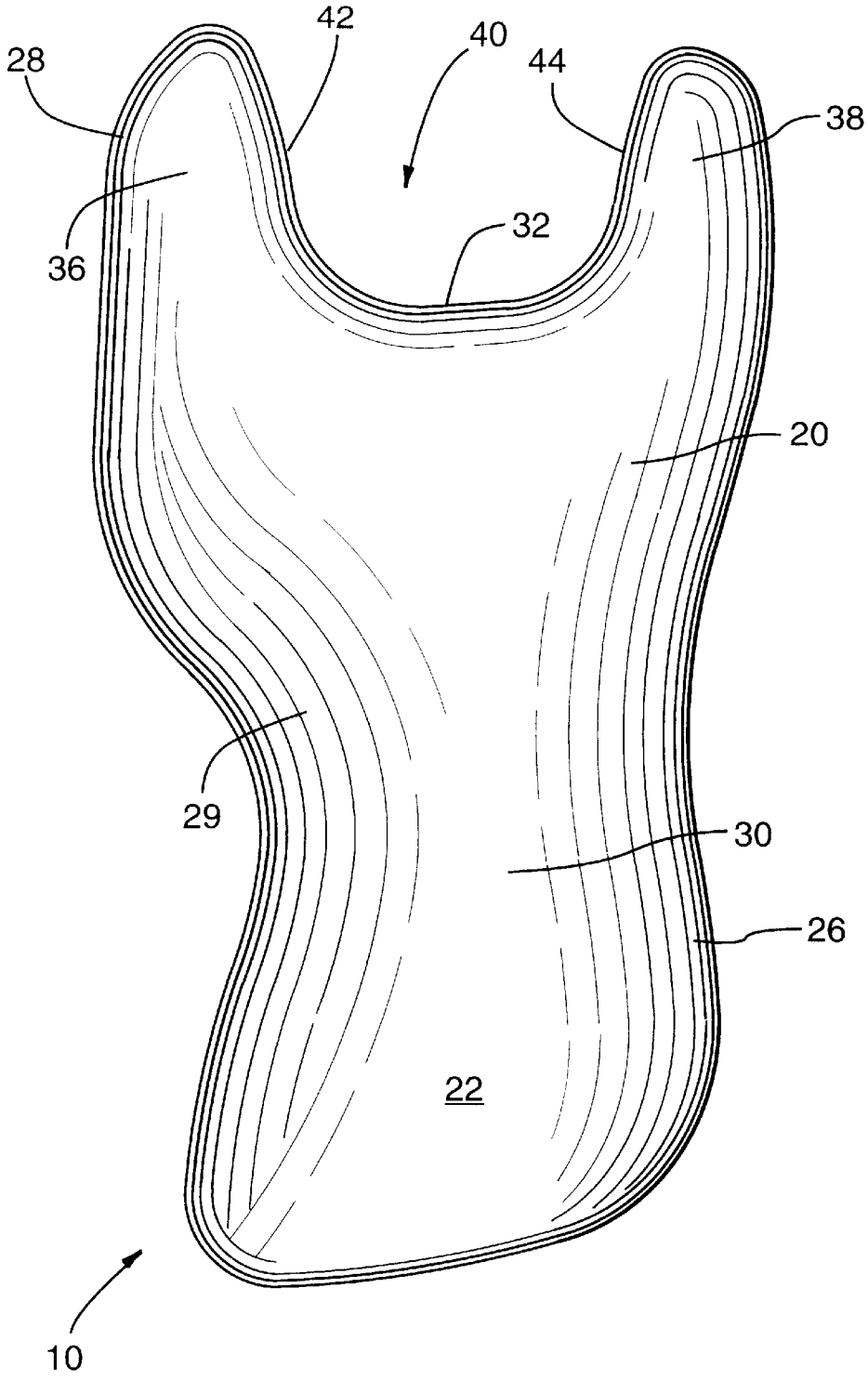
FIG. 2 is a plan view of the wrist support shown in FIG. 1.

The main body portion 20 has an upper side 22 and an underside 24. The main body portion 20 is contoured to cradle the heel of the hand, the wrist and a distal portion of the forearm of a user. As best seen in FIG. 2, the main body portion 20 has longitudinal edges 26, 28 which are raised above the plane of the centre of the main body portion 20. In FIG. 2, the preferred shape of raised longitudinal edges 26, 28 are shown by depicting same by hatched lines. The raised longitudinal edges 26, 28 define therebetween a longitudinally extending channel 30 which supportingly receives the heel of the hand, the wrist and a distal portion of the forearm of a user in a neutral position. The main body portion 20 of the wrist support 10 further comprises a raised protuberance 29, adjacent to and contiguous with longitudinal raised edge 28. This protuberance 29 is preferably substantially crescent shaped, and extends longitudinally adjacent the channel 30 at a position selected to supportingly contact the radial portion of the a user's wrist adjacent the base of the user's thumb. The protuberance 29 provides additional support to the user's wrist and increases the effectiveness of the cradling function of the channel 30.

As shown in FIG. 1, in dotted outline, the main body portion 20 extends longitudinally beyond the heel of the hand of a user to terminal edge 32 which substantially corresponds to the base 34 of the fingers of a user's hand.

A thumb support 36 extends longitudinally beyond the main body portion 20. A fifth finger support 38 also extends longitudinally beyond the main body portion 20. The thumb support 36 and the fifth finger support 38 are each raised slightly above the plane of the main body portion 20 to maintain the thumb and the fifth finger of a user in a raised position relative to the palm of the hand, thus maintaining the heel of the hand firmly within the channel 30 of the main body portion 20. The thumb support 36 is shaped and positioned to maintain the thumb of a user in a laterally abducted position relative to the palm of the hand. The fifth finger support 38 is also shaped and positioned to maintain the thumb of a user in a laterally abducted position relative to the palm of the hand.

When the heel of the hand, the wrist, and the distal portion of the forearm of the user are supportingly received in the channel 30, with the wrist further supported by the protuberance 29, with the thumb resting on the thumb support 36 and the fifth finger resting on the fifth finger support 38, the second, third, and fourth fingers of the hand are maintained in a forwardly extending position to enable the user to comfortably manipulate a computer mouse. The thumb and the fifth finger are each maintained in an isolated position laterally abducted and slightly raised relative to the palm of the hand. This supported orientation of the hand, wrist and forearm of the user upon the wrist support 10 maintains the wrist of the user in a neutral position, and distributes the weight of the user's hand and wrist primarily through the forearm. This redistribution of weight relieves pressure on the areas at the base of the index finger, the base of the fifth finger, and the heel of the hand, which areas would otherwise tend to bear most of the weight of the hand and forearm.

The thumb support 36 and the fifth finger support 38 define a recessed area 40 therebetween. The recessed area is bordered by the inner edges 42 and 44 the thumb support 36 and the fifth finger support 38, respectively, and the terminal edge 32 of the main body portion 20. As best seen in FIG. 1, the recessed area 40 is sized and positioned to receive in non-contacting relation, a computer mouse 12. The wrist support 20 provides sufficient space in the recessed area 40 to permit the free movement of the computer mouse in circular as well as lateral and longitudinal motions during mousing.

Figure 3:
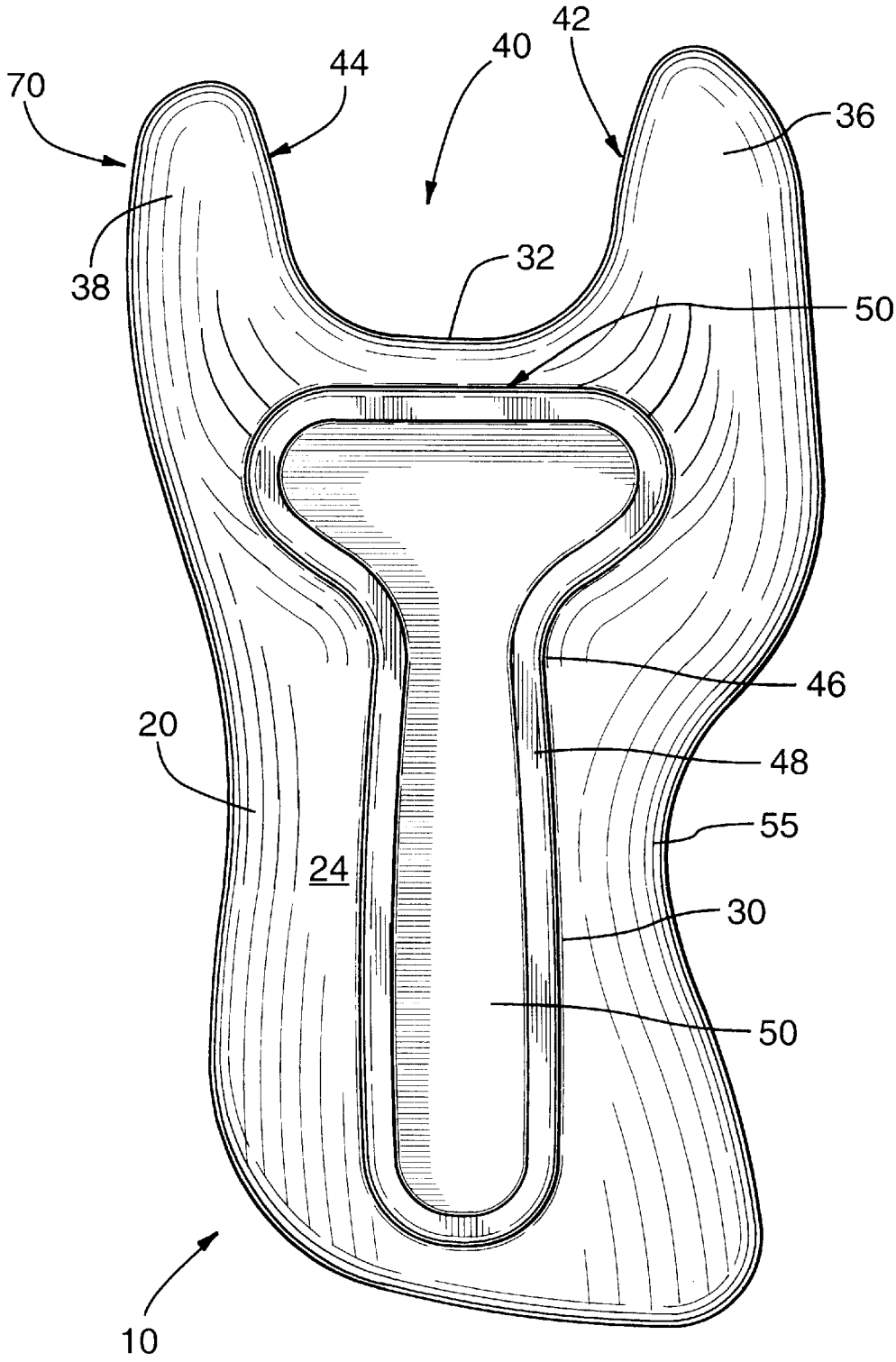
FIG. 3 is a plan view of the bottom of the wrist support shown in FIG. 1.
Figure 4:
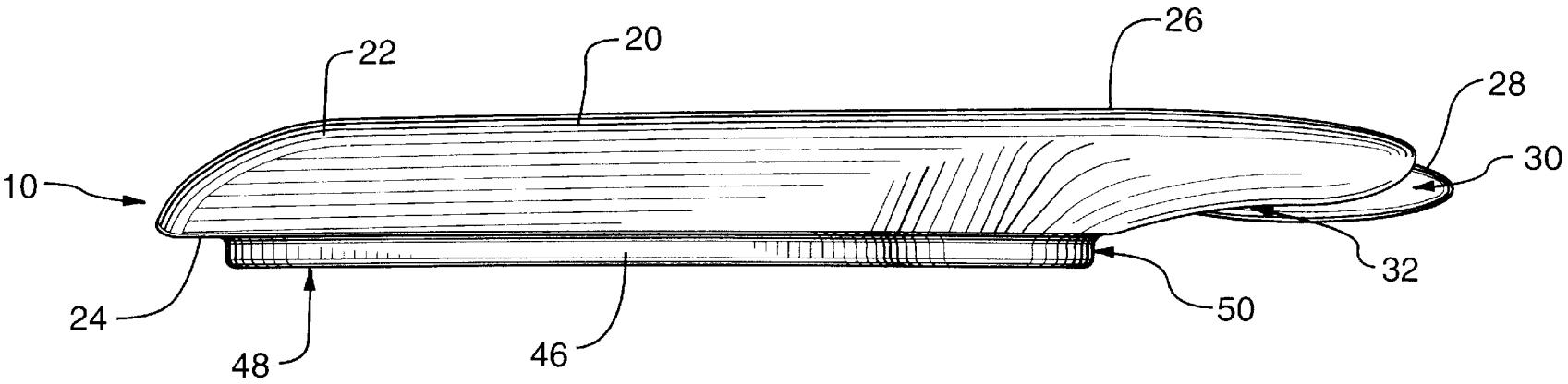
FIG. 4 is a side view of FIG. 3.

As shown in FIGS. 3 and 4, the main body portion 20 of the wrist support 10 has, on the underside 24 thereof, a base portion 46 which is adapted to maintain the main body portion 20 in stable aligned horizontal contact with a hard flat surface such as a table top or desk (not shown). The base portion 46 may be formed integrally with the main body portion 20. The base portion 46 is adapted to glide freely over the hard flat surface. In order to facilitate the ability of the base portion 46 to glide freely over the hard surface, the base portion 46 has a smooth and level contact surface 48. The base portion 46 is sized and positioned to minimize the surface area of contact surface 48 which is in contact with the hard flat surface. As seen most readily in FIG. 3, it is preferred to have the base portion 46 of substantially T-shaped outline. The T-shape of the base portion 46 provides support for the main body portion 20 both longitudinally along its length and extending laterally at a position under the heel of the hand where most of the user's wrist weight will rest. The T-shape of the base portion 46 maximizes the stability of the main body portion 20 and maintains the wrist support 10 in aligned horizontal contact with the hard surface.

The base portion 46 permits the wrist support 10 to glide to a position partially overhanging the edge of a hard flat surface while maintaining the main body portion 20 in stable aligned horizontal contact with a hard flat surface. This functionality is accomplished by means of the shape and positioning of the elongated extension of the T-shape of the base portion 46. The elongated T-shape provides stability to the wrist support 20, so that, while mousing, the user may glide the wrist support 20 somewhat past the edge of a hard working surface. A portion of the elongated extension of the T-shape may be slid past the edge of the working surface to overhang the edge, and, so long as at least the portion of the contact surface 48 which corresponds to the cross bar of the T-shape remains in contact with the working surface, the rigid construction of the main body portion 20 and the base portion 46 of the wrist support 10 will remain balanced under the weight of the user's wrist, with the result that the user's wrist remains cradled within the channel 30 and supported in a neutral position. Without these characteristics of the wrist support 20, the user's wrist would experience hyper flexion when the heel of the user's hand reached a position at or near the edge of the hard working surface during mousing. This ability of the wrist support 10 to cradle the user's wrist in a supported neutral position even when the base portion 46 overhangs the edge of the work surface has a number of advantages. Firstly, since the user does not need to rest his/her forearm and wrist on the work surface itself when using the wrist support 10, the user can manipulate a computer mouse on a relatively small work surface, such as a pull-out keyboard tray. So long as there is sufficient additional space on the work surface to permit the portion of the contact surface 48 which corresponds to the cross bar of the T-shape to remain in contact with the working surface, the main body portion 20 and the base portion 46 of the wrist support 10 will remain balanced under the weight of the user's wrist, and will support the user's wrist and forearm, even though the elongated portion of the T-shape is overhanging the edge of the work surface. Secondly, when a user has to manipulate a computer mouse on a small work surface, the user will ordinarily support the free-hanging weight of the arm and forearm at the shoulder and elbow. Extended periods of time spent in such a working position will cause the user's shoulder and elbow to become tired, and the user may lean sideways to compensate. By leaning, the user shifts his/her spine, thereby distorting body's posture, and possibly causing back and neck aches. When a user works with his/her mousing arm cradled within the wrist support 10, the user's forearm remains supported and much of the weight of the hand, wrist and forearm is distributed to the supported forearm even while the base portion 46 overhangs the edge of the work surface. Thus, the use of the wrist support 10, relieves strain on the user's shoulder and elbow which would otherwise result from the necessity of supporting the weight of the user's arm while mousing.

It is preferable for the base portion 46 to be substantially T-shaped in outline, but hollowed within the substantially a T-shaped boundary, such that the contact surface 48 comprises only the outline of the T-shape. FIG. 3 illustrates the preferred shape of the base portion 46 having a contact surface 48 being substantially T-shaped in outline, with the hollowed area 50 of the base portion 46 bounded by the contact surface 48 being shown with hatched lines. By shaping the base portion 46 to have a contact surface 48 which is substantially T-shaped in outline, as opposed to being a solid T-shape, it is possible to achieve several advantages. First, the surface area of the base portion 46 which is in contact with the working surface is minimized, thus reducing the amount of friction which is generated between the wrist support 20 and the working surface. Secondly, the hollowed construction of the base portion 46 results in less material being used in the construction of the wrist support, with the advantage that the entire wrist support 20 is lighter in weight and easier for the user to glide along the working surface during mousing. The ease of sliding reduces stress to the elbow and shoulder which could otherwise be caused if the user was required to exert significant energy to move the wrist support while manipulating the mouse. Thirdly, the overall manufacturing cost of the wrist support will decrease with a decrease in the amount of material used in the construction thereof.

As best seen in FIG. 4, the base portion 46 does not extend to the terminal edge 32 of the main body portion 10. This lack of forward extension of the base portion 46 permits the use of the wrist support 20 either with or without a mouse pad. A leading edge 50 of the base portion 46 can be brought toward the edge of a mouse pad (not shown), allowing a portion of the mouse pad to extend under the thumb support 38, the fifth finger support 36, and a portion of the main body portion 20 adjacent the terminal edge 32. This positioning of the mouse pad allows for the operation of a computer mouse on a mouse pad when the mouse is received within the recess 40.

The wrist support 20 of the present invention is constructed of a hard smooth material to give the wrist support 20 sufficient rigidity to supportingly receive the heel of the hand, the wrist and a distal portion of the forearm of a user and to maintain same in a neutral position, and to permit the wrist support 10 to glide easily over the hard surface of a desk or table top. The wrist support 10 is preferably constructed from a durable, smooth, easy to clean light weight plastic such as polypropylene. The use of hard plastics achieves the necessary physical characteristics of the wrist support 10, while producing a product which is light weight and can be cost effectively manufactured as a single piece using known molding techniques. It is preferred to construct the wrist support from glass filled polypropylene. It will be obvious to those skilled in the art that other materials could be substituted for the preferred material discussed above.

In the preferred embodiment of the present invention as described above, the wrist support 20 is designed for optimal comfort and effectiveness. The wrist support 20 may be freely moved with the computer mouse 12 by those persons who prefer to manipulate the computer mouse 12 by using large movements of the hand and forearm. The wrist support 10 provides sufficient space within the recess 40 to permit the movement of the computer mouse therein, to facilitate use by persons who prefer to manipulate the computer mouse using smaller circular, lateral and longitudinal motions of the fingers. The wrist support is not attached to the wrist, but rather the wrist remains removably cradled within the channel 30. By not being attached to the wrist, the wrist support 20 gives the user the freedom to easily go from mousing to using the keyboard simply by moving his or her hand.

The wrist support 10 of the present invention can be readily manufactured in varying sizes to fit hands and forearms of different users. Similarly, the wrist support of the present invention can be moulded in both right handed and left handed versions to accommodate users.

It will be appreciated that use of the wrist support of the present invention may greatly facilitate the use of a computer mouse. It will be obvious to those skilled in the art that modifications of the wrist support of the present invention may be adopted without departing from the spirit of the present invention.

For example, a further variation of the wrist support may be employed wherein a computer mouse can be attached to the wrist support either permanently or detachable, whereby the mouse is manipulated by the movement of the wrist support, as controlled by the user moving his/her forearm while it is cradled within the wrist support. Such a variation would eliminate the need for a user to unduly strain the second third and fourth fingers in order to manipulate the mouse.

A further variation would employ a wrist support into which the functionality of a computer mouse is fully integrated. Thus, changes may be made in the combination and arrangement of the various parts, elements, steps and procedures described herein without departing from the spirit and scope of this Invention as defined in the following claims. It will be apparent that the scope of the present invention is limited only by the claims set out hereinbelow.

The embodiment of the invention to which and exclusive property or privilege is claimed are defined as follows:

1. A wrist support for use with a computer mouse comprising:

a substantially rigid main body portion contoured to cradle a heel of the hand, a wrist and a distal portion of the forearm of a user;

wherein the main body portion defines a longitudinally extending channel to supportingly receive the heal of the hand, and wrist and the distal portion of the forearm in a neutral position;

wherein the main body portion extends longitudinally beyond the heal of the hand to terminate a position substantially corresponding to the base of the fingers of the hand;

wherein the main body portion further comprises a protuberance adjacent the longitudinally extending channel at a position selected to supportingly contact the radial portion of the wrist adjacent the base of the user's thumb;

wherein the protuberance is substantially crescent shaped; and a thumb support extending longitudinally beyond the main body portion;

wherein the thumb support is shaped and positioned to maintain the thumb of a user in a laterally abducted position relative to the palm of the hand; and wherein the thumb support is raised above the plane of the body portion to maintain the thumb of a user in a raised position relative to the palm of the hand.

2. The wrist support of claim 1, further comprising a fifth finger support extending longitudinally beyond the main body portion.

3. The wrist support of claim 2 wherein the fifth finger support is shaped and positioned to maintain the fifth finger of a user in a laterally abducted position relative to the remaining fingers of the hand.

4. The wrist support of claim 3 wherein the fifth finger support is raised above the plane of the main body portion to maintain the thumb of a user in a raised position relative to the palm of the hand.

5. The wrist support of claim 2 wherein the thumb support and the fifth finger support define a recessed area therebetween, which recessed area is sized and positioned to receive in non-contacting relation, a computer mouse.

6. The wrist support of claim 1 wherein the main body portion has, on an underside thereof, a base portion adapted to maintain the main body portion in stable aligned horizontal contact with a hard flat surface.

7. The wrist support of claim 6 wherein the base portion is adapted to glide freely over the hard flat surface.

8. The wrist support of claim 6 wherein the base portion is elongated to permit the wrist support to glide to a position partially overhanging the edge of a hard flat surface.

9. The wrist support of claim 6 wherein the base portion is sized and positioned to minimize the surface area thereof which is in said contact with the hard flat surface.

10. The wrist support of claim 9 wherein the base portion is substantially T-shaped in outline.

11. The wrist support of claim 6 wherein the wrist support is constructed from hard smooth material.

12. The wrist support of claim 11 wherein the wrist support is constructed from hard smooth plastic.

13. The wrist support of claim 12 wherein the wrist support is constructed from glass filled polypropylene.

* * * * *